US006146120A

United States Patent [19]

Harms

[11] Patent Number: 6,146,120

[45] Date of Patent: Nov. 14, 2000

[54] ROTARY ENGINE HAVING AN IMPROVED ROTOR STRUCTURE

[75] Inventor: Rod Harms, Tucson, Ariz.

[73] Assignee: Jenn Feng Industrial Co., Ltd.

[21] Appl. No.: 09/124,608

[22] Filed: Jul. 29, 1998

[51] Int. Cl.[7] ..... F03C 2/00

[52] U.S. Cl. ..... 418/61.2; 418/86; 418/151

[58] Field of Search ..... 123/242, 244; 418/61.2, 151, 270, 86

[56] References Cited

U.S. PATENT DOCUMENTS

| | | | |
|---|---|---|---|
| 2,313,387 | 3/1943 | McArthur et al. . | |
| 3,042,009 | 7/1962 | Froede et al. . | |
| 3,112,870 | 12/1963 | Bentele . | |
| 3,265,046 | 8/1966 | Paschke . | |
| 3,319,612 | 5/1967 | Hamada . | |
| 3,424,135 | 1/1969 | Tado . | |
| 3,583,371 | 6/1971 | King . | |
| 3,629,632 | 12/1971 | Loupe . | |
| 3,671,153 | 6/1972 | Luck . | |
| 3,777,720 | 12/1973 | Williams | 418/61.2 |
| 3,779,214 | 12/1973 | Ward, III et al. . | |
| 3,813,190 | 5/1974 | Keating . | |
| 3,813,195 | 5/1974 | King . | |
| 3,881,847 | 5/1975 | Chen | 418/61.2 |
| 3,891,059 | 6/1975 | Jones . | |
| 3,991,722 | 11/1976 | Fujikawa et al. . | |
| 4,009,690 | 3/1977 | Moran | 123/244 |
| 4,132,513 | 1/1979 | Kulina . | |
| 4,175,393 | 11/1979 | Frank | 418/270 |
| 4,278,409 | 7/1981 | Eiermann . | |
| 4,316,439 | 2/1982 | Tyree . | |
| 4,475,875 | 10/1984 | Sugimoto et al. . | |
| 4,486,159 | 12/1984 | Garside . | |
| 4,740,321 | 4/1988 | Davis et al. . | |
| 5,011,385 | 4/1991 | Eiermann . | |
| 5,664,941 | 9/1997 | Bearint | 418/270 |

FOREIGN PATENT DOCUMENTS

| | | |
|---|---|---|
| 62-199990 | 3/1987 | Japan . |
| 62-153591 | 8/1987 | Japan . |

*Primary Examiner*—Thomas Denion
*Assistant Examiner*—Tu M. Nguyen
*Attorney, Agent, or Firm*—Banner & Witcoff, Ltd.

[57] ABSTRACT

A rotary engine includes a rotary shaft, a rotary piston carried by the shaft, a bearing structure supporting the shaft on one side of the rotary piston and a counterweight carried by the shaft on another side of the rotary piston. An air/fuel/oil charge is directed into a recess containing the counterweight and thereafter flows through engine components for cooling prior to combustion thereof in a combustion chamber.

15 Claims, 5 Drawing Sheets

ROTARY ENGINE HAVING AN IMPROVED ROTOR STRUCTURE

TECHNICAL FIELD

The present invention relates generally to internal combustion engines, and more particularly to improvements in assembling and operating a rotary engine.

BACKGROUND ART

A rotary engine includes a rotary piston carried by a rotary shaft and extending into a combustion chamber. An air/fuel charge is sequentially introduced into each of a plurality of working chambers formed by the rotary piston as it rotates in the combustion chamber. Often, a technique known as charge cooling is employed wherein the air/fuel mixture is routed through engine structures prior to introduction thereof into the combustion chamber to cool the internal engine structures. In addition, the fuel may comprise a gasoline/oil mixture so that lubrication of engine components is accomplished.

Because the rotary piston is eccentrically mounted on the rotary shaft, some type of counterweight structure must also be carried by the rotary shaft on both sides of the piston so that vibration is kept to a minimum. Further, the rotary shaft is typically supported by one or more bearings located on both sides of the rotor structure so that bending moments which could further contribute to vibration are minimized.

A conventional rotary engine of the above type has several disadvantages. Because the rotary assembly includes multiple counterweights and bearings, assembly is complex and size, weight and overall cost are increased. Also, even though charge cooling is typically utilized, a separate cooling system may still be required, thereby resulting in the need for a coolant pump and separate flowpaths in the engine for the air/fuel mixture and the coolant. These structures further undesirably add to the size, weight and cost of the engine. Still further, some rotary engines do not utilize a gasoline/oil mixture but instead are fueled by straight gasoline and have a separate lubrication system for lubricating engine components. In this case engine size, weight, complexity and expense are even further increased.

SUMMARY OF THE INVENTION

A rotary engine with an improved rotor structure advantageously minimizes engine size, weight, complexity and cost.

More particularly, in accordance with one aspect of the present invention, a rotary engine includes an engine housing, a rotary shaft and a rotary piston carried by the shaft. The rotary shaft is unsupported on one side of the rotary piston and a bearing structure supports the rotary shaft on another side of the rotary piston opposite the one side.

In accordance with another aspect of the present invention, a rotary engine includes a combustion chamber having a radially innermost extent, a rotary shaft, a rotary piston carried by the shaft and a counterweight also carried by the shaft on one side of the rotary piston. The counterweight has a radially outermost extent less than the radially innermost extent of the combustion chamber. A bearing structure supports the rotary shaft and is disposed solely on another side of the rotary piston opposite the side carrying the counterweight.

In accordance with yet another aspect of the present invention, a rotary engine includes an engine housing, a rotary shaft and a rotary piston carried by the shaft. A counterweight is also carried by the shaft and is disposed in a counterweight recess on one side of the rotary piston and means are provided for conducting an air/fuel/oil charge through the counterweight recess.

Further features and advantages will become apparent from the following description and drawings.

DESCRIPTION OF THE PREFERRED EMBODIMENT

Figure 1:
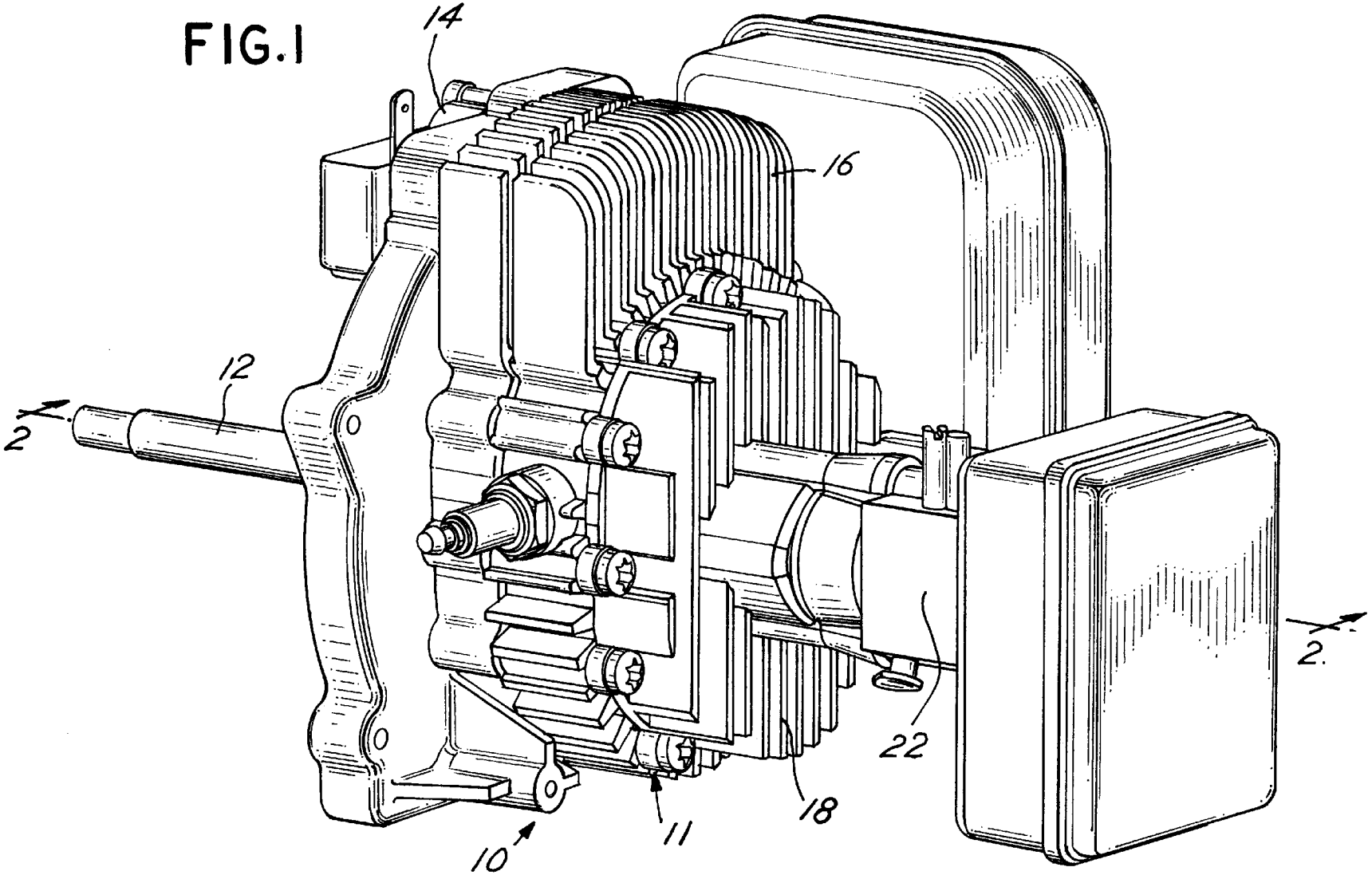
FIG. 1 is an isometric view of a rotary engine incorporating the present invention.
Figure 2:
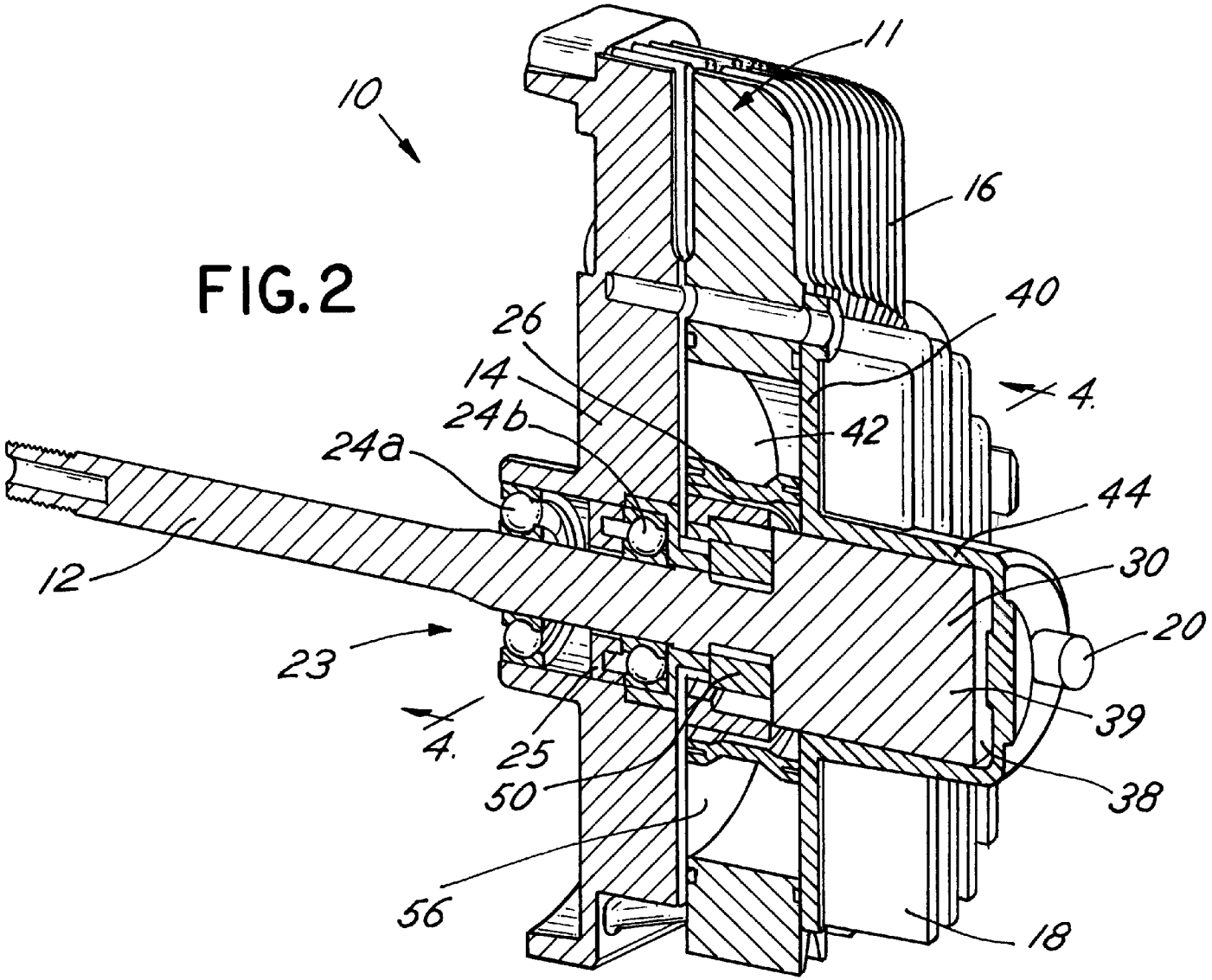
FIG. 2 is a cross-sectional isometric view taken generally along lines 2—2 of FIG. 1 with the carburetor 22 removed.
Figure 3:
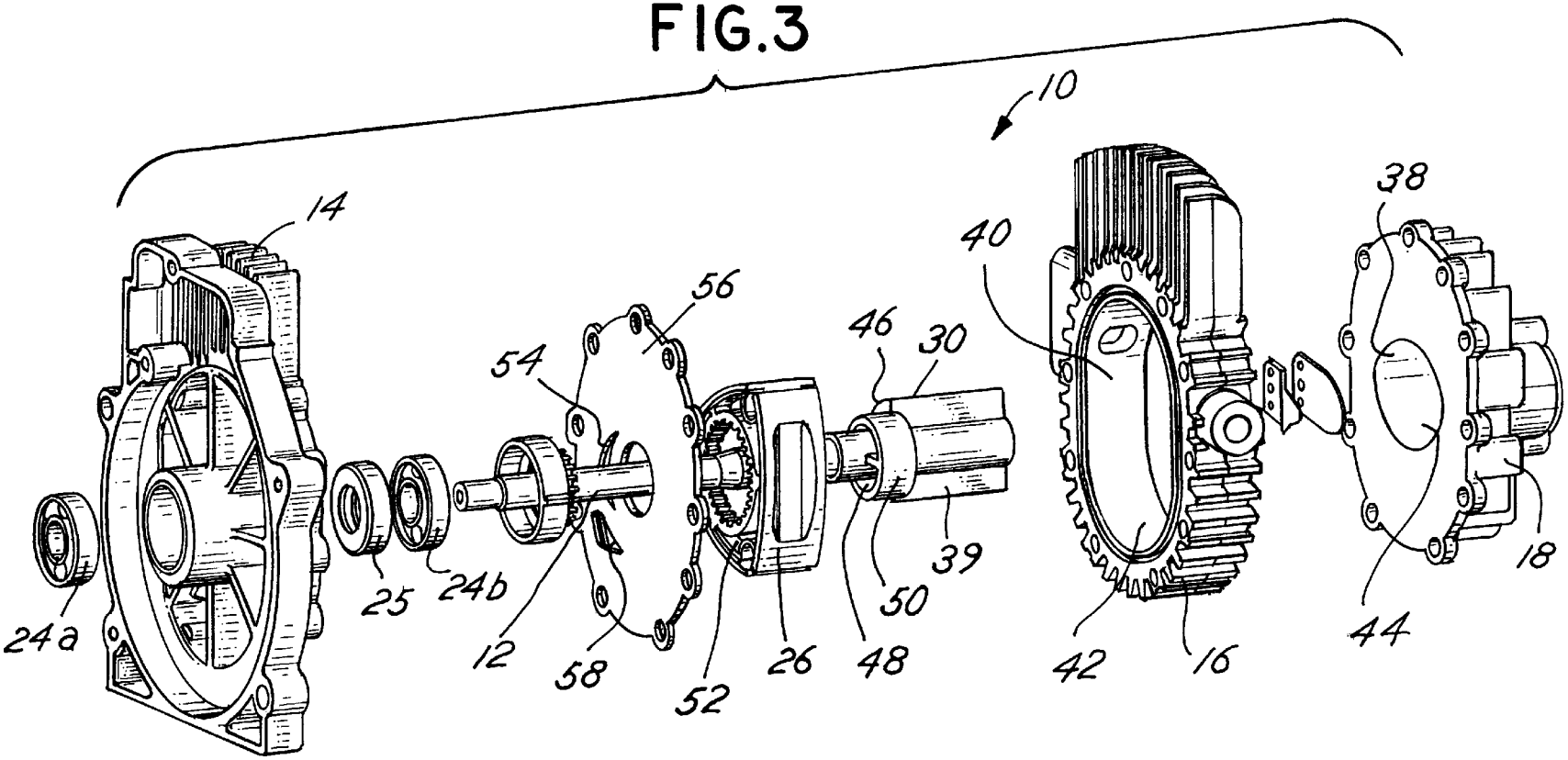
FIG. 3 is an exploded isometric view of the rotary engine of FIGS. 1 and 2.

Referring first to FIGS. 1–3, a rotary engine 10 includes an engine housing 11 and a rotatable shaft 12 supported by a support bearing structure in the housing 11. The housing 11 comprises a front housing portion 14, a rear housing portion 16 and a rear cover 18 having a passage forming an opening 20, as best seen in FIGS. 2 and 3. Attached to the rear cover 18 is an air/fuel/oil charge source or carburetor 22. The carburetor 22 provides an air/fuel/oil charge or mixture through the opening 20 to other engine components as noted in greater detail hereinafter.

Referring specifically to FIG. 2, the shaft 12 is supported in a cantilever fashion by a bearing structure 23 comprising first and second bearings 24*a* and 24*b* which are preferably spaced from one another. Between the first and second bearings 24*a* and 24*b* is a shaft seal 25. A rotor assembly including a rotary piston 26 is coupled to the shaft 12. In the preferred embodiment, the shaft 12 is supported only on the front side of the rotary piston 26 by the bearings 24*a* and 24*b*.

Preferably, a single counterweight 30 is carried by the shaft 12 on a rear side of the rotary piston 26 opposite the front side. This is contrasted to the conventional practice of utilizing dual counterweights disposed on either side of the piston 26 in prior engine designs. The counterweight 30 is disposed in a counterweight recess or chamber 38 formed in the rear cover 18. The counterweight 30 comprises an eccentrically disposed mass including a main portion 39 which balances the eccentrically disposed mass of the rotary piston 26 to limit forces tending to vibrate the engine 10. The counterweight 30 has an outer radial extent which is less than an inner radial extent of walls 40 of the engine housing 11 defining a combustion chamber 42. Specifically, the counterweight recess 38 is defined by a cylindrical wall 44 which defines the radially inward extent of the combustion chamber 42 and the main portion 39 of the counterweight 30 has an outer partially cylindrical surface 46 which is spaced radially inwardly from the cylindrical wall 44. The counterweight 30 is disposed adjacent the opening 20.

Figure 4:
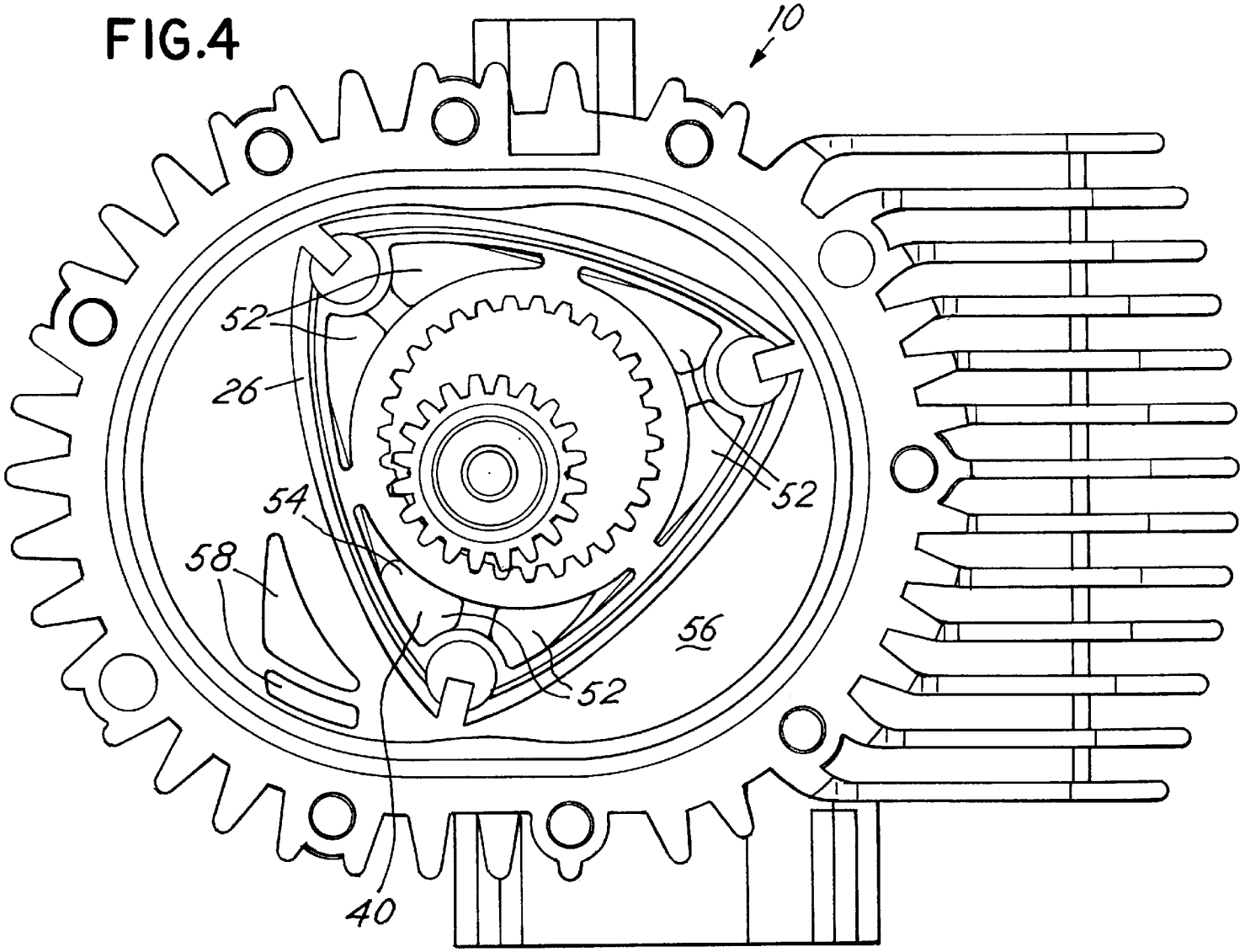
FIG. 4 comprises a sectional view of the rotary engine taken generally along the lines 4—4 of FIG. 2.
Figure 5:
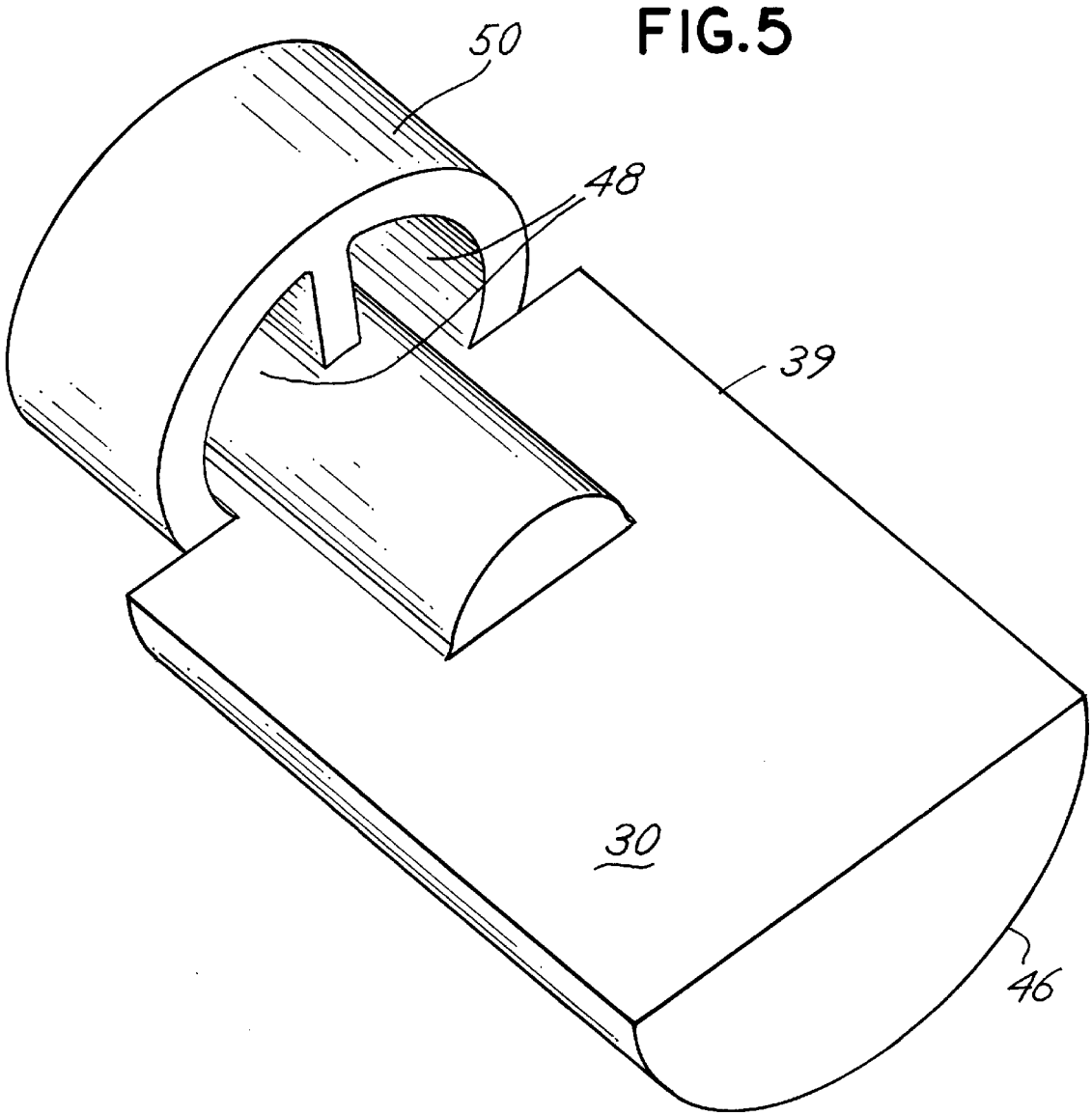
FIG. 5 is an isometric view of the counterweight of FIGS. 2 and 3.

After the air/fuel/oil mixture enters through the carburetor and rear cover opening 20, it passes through the counterweight recess 38. During passage through the recess 38, the air/fuel/oil charge is mixed and distributed by the rotating counterweight 30. Thereafter, the air/fuel/oil mixture passes through a plurality of openings 48 located in an auxiliary portion 50 of the counterweight 30 (FIGS. 3 and 5) and thence through openings 52 extending fully through the center of the rotary piston 26, as best seen in FIG. 4. After passing through the openings 52, the mixture then enters a central opening 54 in a front wall 56 of the front housing portion 14, as shown in FIGS. 3 and 4. After passing behind the front wall 56, the mixture passes through outer openings 58 in the front wall 56 into the combustion chamber 42.

The simplification of the rotary engine assembly design by eliminating the additional support bearings and counterweights allows the rotary engine assembly to be machined and assembled less expensively. Unlike the prior art, attached to the shaft in the present invention is a single counterweight, which has an elongated axial dimension that allows the radial dimension to be kept small and yet still provides enough mass to keep vibrations to a minimum. In addition, the shaft does not have any support bearings located on the second side of the rotor, and hence there is no need for special, and more expensive, machining of the rear cover and assembly of the engine 10 is greatly simplified. Furthermore, since no support bearings are located between the rotary piston 26 and the counterweight, it is possible to place the counterweight 30 in close proximity to the rotary piston 26 so that less counterweight mass is needed to minimize vibrations.

Furthermore, unlike the prior art, the present invention both cools the rotor assembly and lubricates the bearings using only one mixture and one flowpath. Even though only one flow path is utilized, proper distribution of the lubricating oil to the rotor bearings, gearing and other internal surfaces is ensured since the cantilevered counterweight also imparts a mixing action to the incoming fuel mixture. Because only a single flowpath is used, the engine 10 is less complex, less expensive to assemble, light in weight and small in size. This is particularly important in small engine applications in which the engine is to be owned and operated by individual consumers, such as in lawn and garden equipment.

Although the invention has been described with reference to a specific embodiment, various changes and modifications may be made thereto without departing from the scope of the invention, as should be evident to one of ordinary skill in the art. This invention is intended to cover all such modifications.

What is claimed is:

1. A rotary engine, comprising:

an engine housing defining a combustion chamber;

a rotary shaft supported by the housing and extending through the combustion chamber along a shaft axis;

a rotary piston coupled to the shaft and located in the combustion chamber for rotation with the shaft, said piston having a first side and a second side;

a counterweight carried on the rotary shaft only on the first side of the rotary piston for balancing the rotary shaft of the engine during operation thereof; and a bearing structure in the housing for supporting the rotary shaft only on the second side of the rotary piston opposite the first side to thereby provide cantilever support of the piston and the counterweight by the bearing structure.

2. The rotary engine of claim 1, wherein the bearing structure comprises a pair of bearings.

3. The rotary engine of claim 1, wherein the counterweight is disposed in a counterweight recess and wherein the engine housing includes a passage which directs fuel through the counterweight recess.

4. The rotary engine of claim 1, wherein the housing includes a passage which directs fuel to engine components.

5. The rotary engine of claim 2, wherein the pair of bearings are axially aligned on the second side of the rotary piston.

6. The rotary engine of claim 1, wherein the counterweight is disposed in a counterweight recess.

7. A rotary engine, comprising:

an engine housing defining a combustion chamber;

the combustion chamber having a radially innermost extent;

a rotary shaft supported by the housing and extending through the combustion chamber along a shaft axis;

a rotary piston coupled to the shaft and located in the combustion chamber for rotation with the shaft, said piston having a first side and a second side;

a counterweight carried on the shaft only on the first side of the rotary piston for balancing the rotary shaft of the engine during operation thereof, wherein the counterweight has a radially outermost extent less than the radially innermost extent of the combustion chamber; and a bearing structure in the housing for supporting the rotary shaft only on the second side of the rotary piston opposite the first side to thereby provide cantilever support of the piston and the counterweight by the bearing structure.

8. The rotary engine of claim 7, wherein the bearing structure comprises a pair of bearings.

9. The rotary engine of claim 7, wherein the counterweight is disposed in a counterweight recess and the combustion chamber is defined by an engine housing and wherein the engine housing includes a passage which directs fuel to the counterweight recess.

10. The rotary engine of claim 9, wherein the engine housing includes a further passage which directs fuel to an engine component.

11. The rotary engine of claim 8, wherein the pair of bearings are axially aligned on the second side of the rotary piston.

12. A rotary engine, comprising:

an engine housing defining a combustion chamber;

a rotary shaft supported by the housing and extending through the combustion chamber along a shaft axis;

a rotary piston coupled to the shaft and located in the combustion chamber for rotation with the shaft, said piston having a first side and a second side;

a counterweight carried on the shaft only on the first side of the rotary piston for balancing the rotary shaft of the engine during operation thereof the counterweight disposed in a counterweight recess on the first side of the rotary piston;

a bearing structure in the housing for supporting the rotary shaft only on the second side of the rotary piston opposite the first side to thereby provide cantilever support of the piston and the counterweight by the bearing structure; and means for conducting an air/fuel/oil charge through the counterweight recess.

13. The rotary engine of claim 12, wherein the counterweight has an outer diameter less than a radially innermost extent of portions of the engine housing defining a combustion chamber.

14. The rotary engine of claim 12, wherein the bearing structure comprises a pair of bearings.

15. The rotary engine of claim 14, wherein the pair of bearings are axially aligned on the second side of the rotary piston.

* * * * *